United States Patent [19]

Wirtgen

[11] 3,975,055

[45] Aug. 17, 1976

[54] APPARATUS FOR MILLING ROAD SURFACES

[76] Inventor: Reinhard Wirtgen, Hohner Strasse, 5461 Windhagen, Germany

[22] Filed: May 6, 1974

[21] Appl. No.: 466,966

Related U.S. Application Data

[62] Division of Ser. No. 244,775, April 17, 1972, Pat. No. 3,829,161.

[30] Foreign Application Priority Data

Apr. 16, 1971 Germany ..... 2118458

[52] U.S. Cl. ..... 299/39; 51/176

[51] Int. Cl.[2] ..... E01C 23/09

[58] Field of Search ..... 299/39, 40, 41; 51/176

[56] References Cited

UNITED STATES PATENTS

| | | | |
|---|---|---|---|
| 1,812,771 | 6/1931 | Blood et al. | 299/41 |
| 3,606,468 | 9/1971 | Walker et al. | 299/39 |
| 3,606,469 | 9/1971 | Hughes | 299/39 |
| 3,608,969 | 9/1971 | Fowkes | 299/39 |
| 3,724,900 | 4/1973 | Hatcher et al. | 299/39 |

*Primary Examiner*—Ernest R. Purser

*Attorney, Agent, or Firm*—Flynn and Frishauf

[57] ABSTRACT

Apparatus and method for milling road surfaces wherein a motor driven rotatable roller, equipped with hard-metal cutters, is moved horizontally relative to the road surface, while support wheels, adjustable by individual screw jacks or hydraulic jacking cylinders, make it possible to adjust the vertical height of the end bearings of the roller with respect to the road surface. The roller is rotated in a direction opposite to the direction of forward movement of the axis of the roller relative to the road surface. That is, the cutters mill the road surface in a direction of forward movement of the axis of the roller.

11 Claims, 1 Drawing Figure

APPARATUS FOR MILLING ROAD SURFACES

This is a division of application Ser. No. 244,775, filed Apr. 17,1972 and now U.S. Pat. No. 3,829,161.

The present invention relates to apparatus for milling road surfaces, and more particularly for milling road surfaces made from concrete, asphalt, or the like, to a controllable depth.

The use of spiked tires during the winter months is to an increasing extent leading to unequal wear of the surfaces of highways and motorways in particular. Attempts to repair this damage is proving extraordinarily difficult, especially since a localised improvment simply does not prove permanent and, from a practical point of view, is not even feasible.

Attempts have already been made to repair localised damage, particularly in the constantly used inside lane, by removing a layer over the whole road surface up to a depth of 2 cm., for example, in order that a regular surface can be obtained which can then by fully recoated, if so required.

Removing a uniform amount from the road surface is, however, very difficult and above all expensive.

With asphalt or bituminous surfaces there has already been developed, for this purpose, a method whereby the surface is preheated by gas burners and then a layer of a predetermined depth is removed by means of plane or cutter-like implements. Such a method, however, is extraordinarily time-consuming and expensive, in particular because of the prolonged pre-heating and has not proved successful in practice.

In addition, attempts have also been made to carry out removal without the time-consuming preheating and to tackle the road-surfacings of asphalt or concrete directly by means of cutter-like tools and thus remove the required amount of material. Devices have already been developed to carry out this method, which devices consist of a chasis, preferably provided with its own drive mechanism, and a motor-driven roller equipped with tungsten carbide cutters, said roller being mounted horizontally in relation to the road surface and vertically adjustable. The width of the cutter roll is approximately the same or less than the total width of the machine.

By means of a cutter roller rotating in the same direction as the propulsion wheels turn where the machine advances, a definite amount of road surfacing is removed by the carbide cutters mounted on the cutter roller and is scooped up behind the roller. Although the results obtained by this method are relatively good, the amount of wear on the carbide cutters has proved enormously high and is an economic stumbling block in the use of such a cutting machine.

Continuous developments in the realm of materials have made new and harder alloys available for the hard-metal cutters, but unfortunately the more the hardness increases the less is the flexibility and toughness of the material, with the result that these materials are no longer suitable for use in the above-described cutter mechanism, since the cutters break up too easily.

In addition, practical experience with such a cutter mechanism has shown that, particularly with relatively hard road surfaces, there occurs relatively high vibration in the whole cutter mechanism which leads to an increased load on the cutters and irregular cutting away of the road surface.

The aim of the present invention is to create a method and mechanical means by means of which the wear on the cutters is reduced and, furthermore, the use of very hard modern cutter materials is made possible. In addition, a more regular cutting effect is to be obtained which is ensured even when the cutting width is large.

The driving and steering wheels of the chassis are usually four wheels either largely of rubber or provided with pneumatic tires. The operation of the cutter roller, however, produces a relatively strong vibration of the entire machine, with the wheels as shock mounts, that leads to an irregular milling of the road surface, which leads to unevenness in the surface as prepared by the machine which is highly undesirable.

It is known from the disclosure of German published patent application (OS) No. 1,459,741, to regulate the depth of the cutter tool in its path of travel by support wheels or rollers. These rollers are mounted on bushings on eccentric studs that are affixed eccentrically on a cylindrical piece held in a bore of the swinging frame and capable of being fixed in any of the positions in which it can be rotated relative to the pivoted cutter frame by means of screw studs and lock nuts. In this manner, the depth of cut is adjustable within a small range. For every change of the adjustment of the depth of cut, however, the road milling machine must be stopped and the vertical adjustment can be carried out only in a time-consuming manner by interruption of the milling operation and loosening of the studs and nuts.

It was found, moreover, that the wear on hard-metal cutters can be considerably reduced, and that hard-metal cutters in particular, of extraordinary hardness but with the reduced toughness unfortunately associated with this, can be used if the cutter roller of the above-described cutting device is not rotated as previously, but is opposed in its action by the direction of rotation of the wheels of the advancing chassis.

It is not an obvious step to utilise an opposite direction of rotation of the cutter roller since in so doing the cut material is not deliver behind the cutter roller but in front of same and thus offers an impediment to the forward movement of the chassis and thus to the cutter roller itself. Furthermore, the operation of the roller tends to move the chassis backwards and puts a strain on the drive motor and drive wheels.

Surprisingly enough this is in fact only an apparent disadvantage since the cut-up material is stored to only a certain depth in front of the cutter roller. If this depth is exceeded the cutter roll then operates as a conveyor roller as well and transports the cut material backwards over the roller (with reference to the direction of travel) where it is stored and if necessary caught by one or more pusher blades which are mounted on the chassis behind the roller, and gathered together or transported to the side.

This surprising and completely unexpected result, obtained by reversing the direction of rotation of the cutter roller, as regards resistance to wear of the hard-metal cutters being used and in particular as regards the possibility of using significantly harder cutters which are nonetheless less reslient and tough, can only be explained by the different cutting angle of the cutters in relation to the road surface. If the cutter roller rotates so that its top surface moves in the direction of the forward movement of the chassis then the cutters mounted on the roller meet the road surface to be milled at a relatively obtuse angle. This relatively obtuse impact requires a high degree of resilience and toughness on the part of the cutter material in order to prevent the break-up of the cutter. For this reason extremely hard cutter materials are not suitable.

SUBJECT MATTER OF THE PRESENT INVENTION

Briefly, by reversing the direction of rotation of the cutter roll and having it turn in a direction opposing the force of the drive of the chassis wheels, the operating or impact angle at which the individual cutters of the cutter roll meet the road surface is advantageously altered. Since each cutter so to speak comes into play in the tracks of its predecessor each cutter meets the roadway to be removed at a very acute angle with the result that any obtuse impact on the roadway is avoided. This has the result that such great stresses regarding resilience and toughness are no longer placed on the cutter material and consequently considerably harder cutters can be used. The life of such cutters is however much greater with the result that from an economic point of view there are considerable benefits to be derived, and the method of the invention can now be put into use to its maximum extent under economically favourable conditions. The cutter roller at both its terminal securing points is provided with one or more support wheels resting directly upon the road surface.

In this way any vibrations arising in the chassis are completely avoided and there is thus obtained a hitherto unattainable accuracy of cut.

The support wheels mounted on the two end bearings of the roller are designed in accordance with a particularly advantageous embodiment of the present invention with vertical adjustment in relation to the bearings. Such vertical adjustment can be obtained appropriately by means of elevating screws. It is also possible, naturally, to use hydraulic jacking cylinders. The jack screws have proved to be particularly advantageous because they enable precise vertical adjustment of the support wheels in a simple manner.

The support wheels are preferably mounted laterally beside the cutter roller at its mounting supports.

In order to enable the road surfaces to be dealt with right up to the edge, in particular it has proved advantageous for the support wheels to be mounted in front of the roller at its support mountings, viewed from the direction of travel.

According to a particularly advantageous embodiment the support wheels are secured behind the roller (viewed from the direction of travel) at its mountings. The support wheels thus rest on the completely level road surface which has already been milled, with the result that these wheels which are ultimately responsible for the precise guidance of the cutter roller, guide the roller at a constant distance over the road surface.

Since the support wheels are secured directly to the support mounting or bearing of the cutter roller and rest firmly on the road surface all vibrations during operation of the cutter roller are reliably avoided and this is true even on very hard road surfaces, for example those made from concrete.

The support wheels are preferably designed as solid rubber tires or steel wheels. In this way any unnecessary vibration is completely excluded which might have an adverse effect on the cutting properties of the roller.

If the support wheels, viewed from the direction of travel, are mounted behind the cutter roller, then it has been proved to be particularly useful for one or more pusher blades to be mounted in front of the support wheels to remove the cut material. In this way there is no risk of the cut material interfering with the regular passage of the support wheels and in this way the vertical adjustment of the roller in relation to the smoothly milled road surface is not adversely affected.

The support wheels are normally secured as single wheels to the two support mountings for the cutter roller. The stability of the whole cutting mechanism is, however, further increased if the support wheels mounted on each side are connected to each other by a common axle.

The application pressure of the support wheels on the road surface can be regulated by means of the vertical adjustment device for the cutter roller and if necessary the whole weight loading the front wheels of the chassis can, practically speaking, be shifted to the support wheels.

BRIEF DESCRIPTION OF THE DRAWINGS

The embodiment shown by way of example in the single FIGURE of accompanying drawings serves for further explanation of the invention. This FIGURE shows: a side view of mechanical means according to the invention for the milling of road surfaces, which is provided with support wheels mounted on the end support mountings of the cutter roller that rest themselves on the road surface.

DESCRIPTION OF THE PREFERRED EMBODIMENT

Figure 1:
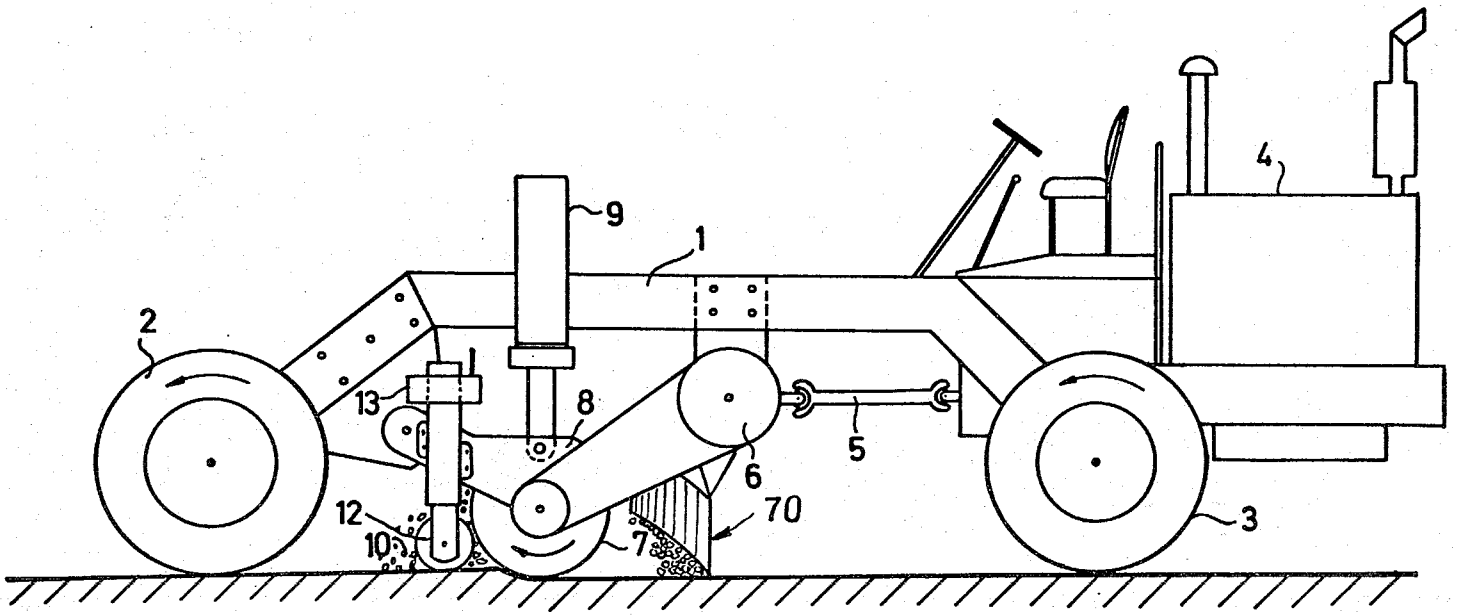

The inventive mechanical means shown in FIG. 1 comprises a chassis 1 with a steerable pair of front wheels 2 and rear wheels 3 which are propelled forward by a motor 4 which also drives the cutter roller 7 through the universal shaft 5 and the transmission 6. The vertical adjustment of the cutter roller 7 is effected by the support mounting 8 and the hydraulic cylinder 9.

The direction of rotation of the cutter roller 7 is shown by the arrow and is opposite to the direction of movement of the chassis. This means that the cut material 10 assemblies in front of the cutter roller up to a certain height and is then transported to the rear by this roller. The direction of forward movement of the chassis 1 can be seen from the arrows which are located at the front and rear wheels.

Viewed from the direction of travel of the cutter roller, the cut material gathers, as shown also in FIG. 1, in front of the cutter roller and is finally, when it has reached a preset hieght, transported to the rear over the roller by the hard metal cutters 11 acting as conveyor elements.

On the support mountings 8, which are in front of the cutter roller 7 as viewed from the direction of travel, a support wheel 12 is mounted on each side which is guided with vertical adjustment by means of a screwed jack 13.

This support wheel 12 can, according to another embodiment of the present invention, be mounted behind the cutter roller at the appropriately shaped mounting again as viewed from the direction of travel. The mounting can, naturally, also be effected on the inside face of the support mounting and it is simply for the sake of better illustrating the arrangement that it is secure, in the example shown, on the outside of the cutter roller mounting.

While the invention has been described with respect to specific embodiments, it should be clear that various modifications and alterations can be made to the structural arrangement without departing from the inventive concept set forth in the accompanying claims.

I claim:

1. Apparatus for milling road surfaces comprising:

a rigid movable chassis provided with wheels for supporting and moving it on a road surface and means for driving at least some of said wheels;

a rotatable roller carrying hard-metal cutters thereon;

means for mounting said roller at each end in a vertically adjustable position with respect to said chassis including at least one vertically adjustable support wheel, each such support wheel (12), being provided with jack means for support height adjustment in relation to the road surface; and means for rotating said roller in a direction of rotation opposing forward traction of the chassis wheels when said cutters engage said road surface during rotation of said roller and forward movement of said chassis.

2. Apparatus according to claim 1 wherein said roller is supported at each end by end support mountings and is provided at each of its two end supports with at least one support wheel which rests on the road surface.

3. Apparatus according to claim 2 wherein said end support mountings are pivotally connected to said chassis.

4. Apparatus according to claim 2 wherein each said support wheel is independently adjustable vertically by individual screw jack means for support height adjustment in relation to said end support mountings.

5. Apparatus according to claim 4 wherein at least one pair of said support wheels mounted at said supports on either side of said roller are connected to each other by a common axis member.

6. Apparatus according to claim 1 wherein said chassis is motor driven, said rotating means includes a drive system driven by the motor driving said chassis, and said roller forms a single unit along with said drive system, said single unit being coupled to said chassis suspension mountings at least part of which are vertically adjustable.

7. Apparatus according to claim 1 wherein said cutters extend from said roller and are of a form such as to convey cut road surface material backwards over said roller during rotation thereof when the cut road surface material reaches a predetermined depth in front of said roller.

8. Apparatus for milling a road surface comprising a rigid, motor driven wheeled chassis having wheels remaining in contact with the road surface during the milling operation, further comprising a motor driven roller equipped with hard-metal cutters and rotatable so as to perform milling of said road surface, said roller being fastened to said chassis by vertically adjustable mountings at the ends of said roller, each of said mountings for said roller being provided for vertical adjustment thereof with at least one support wheel (12) that is vertically adjustable, and further comprising the improvement that each support wheel (12) is provided with an individual support height adjustment means comprising a screw jack (13).

9. Apparatus as defined in claim 8 in which each support height adjustment means for a support wheel (12) is disposed laterally adjacent to and is attached to one of said mountings (8) at the respective ends of said roller.

10. Apparatus as defined in claim 8 in which said support height adjustment means for said support wheels (12) are attached to said mountings (8) forward of said roller (7) in the direction of travel of said roller and chassis.

11. Apparatus as defined in claim 8 in which said support height adjustment means for said support wheels (12) are attached to said mountings behind said roller (7) as determined by the direction of travel of said chassis and said roller.

* * * * *